US009901126B2

(12) United States Patent
Willams

(10) Patent No.: US 9,901,126 B2
(45) Date of Patent: Feb. 27, 2018

(54) PROTECTIVE GARMENT ASSEMBLY

(71) Applicant: Leroy Willams, Calumet City, IL (US)

(72) Inventor: Leroy Willams, Calumet City, IL (US)

( * ) Notice: Subject to any disclaimer, the term of this patent is extended or adjusted under 35 U.S.C. 154(b) by 286 days.

(21) Appl. No.: 14/795,938

(22) Filed: Jul. 10, 2015

(65) Prior Publication Data

US 2017/0006928 A1 Jan. 12, 2017

(51) Int. Cl.

| | |
|---|---|
| ***A41D 13/00*** | (2006.01) |
| ***F41H 5/08*** | (2006.01) |
| ***A41D 13/015*** | (2006.01) |
| ***A41D 13/05*** | (2006.01) |

(52) U.S. Cl.

CPC ..... *A41D 13/0002* (2013.01); *A41D 13/0156* (2013.01); *A41D 13/0581* (2013.01); *F41H 5/08* (2013.01)

(58) Field of Classification Search

CPC ..... A41D 13/0002; A41D 13/0581; A41D 13/0156; A41D 13/0015

USPC ..... 2/2.5, 115, 69, 69.5; 602/20, 23

See application file for complete search history.

(56) References Cited

U.S. PATENT DOCUMENTS

| | | | | |
|---|---|---|---|---|
| 1,144,150 A | | 6/1915 | Marcovsky | |
| 2,317,768 A | * | 4/1943 | Holland | A41D 1/06 2/227 |
| 3,758,963 A | | 9/1973 | Knight | |
| 3,925,839 A | * | 12/1975 | Smith | B63C 9/093 2/2.15 |
| 4,356,569 A | * | 11/1982 | Sullivan | F41H 1/02 2/2.5 |
| 4,580,296 A | | 4/1986 | Cano | |
| 4,783,853 A | | 11/1988 | Zuber | |
| 4,833,729 A | * | 5/1989 | Fox | A41D 13/012 2/2.15 |
| 5,052,052 A | | 10/1991 | Gilford et al. | |
| 6,745,394 B1 | * | 6/2004 | Rutherford | F41H 1/02 2/2.5 |
| 7,650,648 B2 | | 1/2010 | Roberts | |
| 8,686,908 B2 | * | 4/2014 | Kusunoki | G04G 21/04 343/702 |
| 2010/0212056 A1 | * | 8/2010 | Sullivan | F41H 1/02 2/2.5 |
| 2010/0319098 A1 | | 12/2010 | Wait | |

* cited by examiner

*Primary Examiner* — Katherine Moran

(57) ABSTRACT

A protective garment assembly for preventing a constricting snake from attacking a user includes a suit that may be worn by the user. A body portion of the suit may be worn on the user's torso. A pair of arm portions of the suit each may be positioned around an associated one of the user's arms. A plurality of leg portions of the suit each may be positioned around an associated one of the user's legs. A plurality of blades is coupled to each of the body, arm and leg portions of the suit. A constricting snake cannot constrict the user without being injured by the plurality of blades.

13 Claims, 3 Drawing Sheets

PROTECTIVE GARMENT ASSEMBLY

BACKGROUND OF THE DISCLOSURE

Field of the Disclosure

The disclosure relates to garment devices and more particularly pertains to a new garment device for preventing a constricting snake from attacking a user.

SUMMARY OF THE DISCLOSURE

An embodiment of the disclosure meets the needs presented above by generally comprising a suit that may be worn by a user. A body portion of the suit may be worn on the user's torso. A pair of arm portions of the suit each may be positioned around an associated one of the user's arms. A plurality of leg portions of the suit each may be positioned around an associated one of the user's legs. A plurality of blades is coupled to each of the body, arm and leg portions of the suit. A constricting snake cannot constrict the user without being injured by the plurality of blades.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
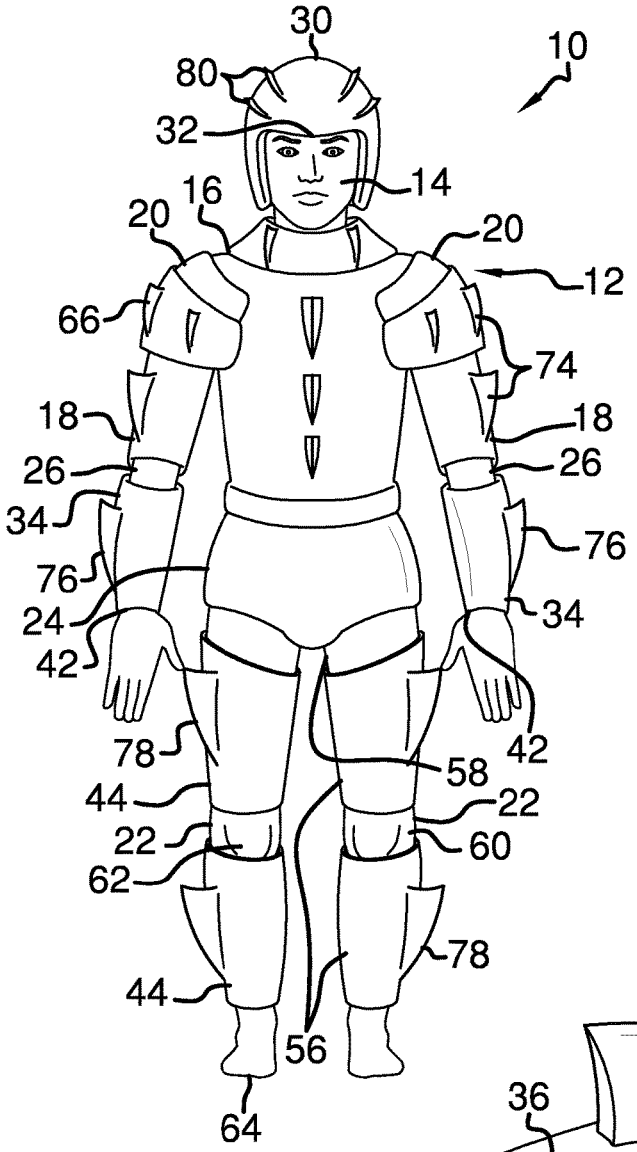
FIG. 1 is a front view of a protective garment assembly according to an embodiment of the disclosure.
Figure 2:
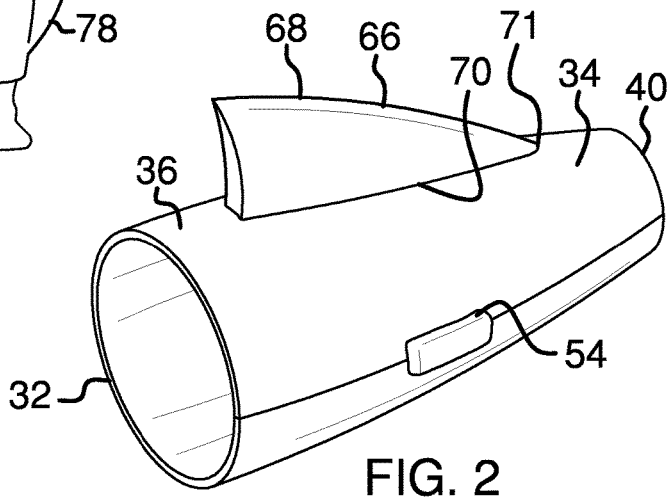
FIG. 2 is a perspective view of an embodiment of the disclosure.
Figure 3:
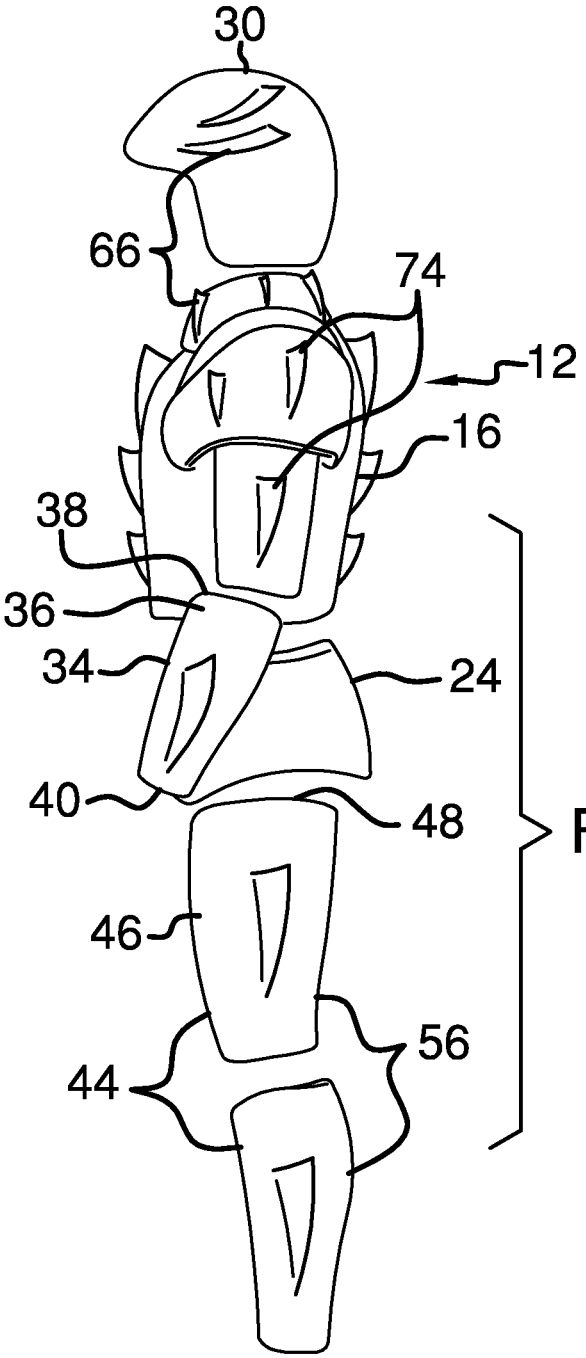
FIG. 3 is a left side view of an embodiment of the disclosure.
Figure 4:
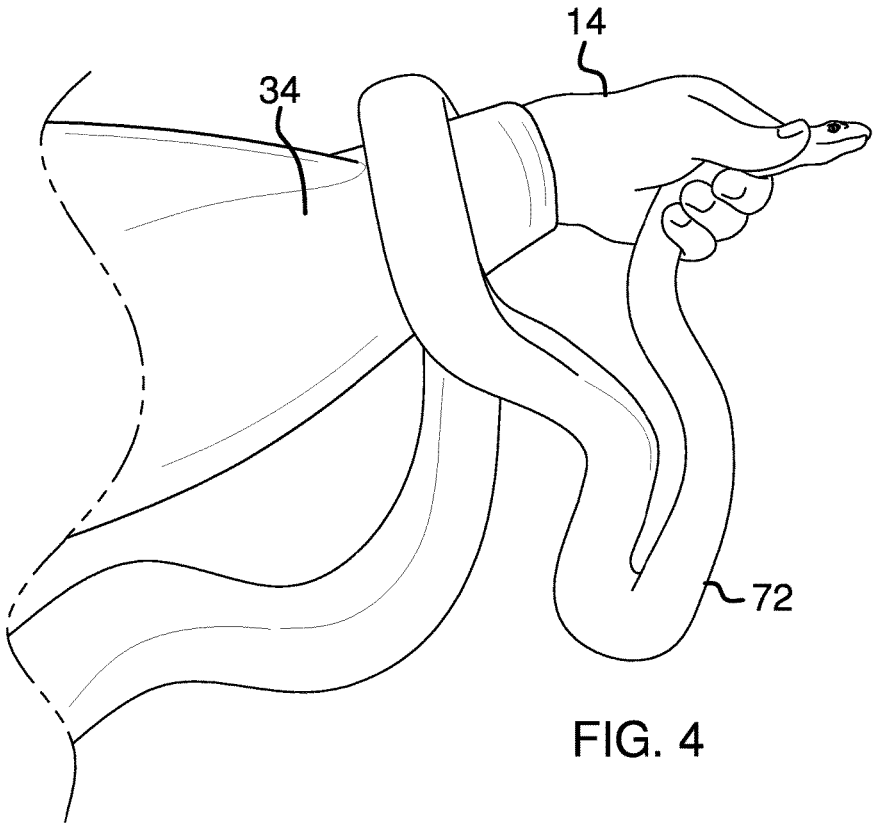
FIG. 4 is an in-use view of an embodiment of the disclosure.

With reference now to the drawings, and in particular to FIGS. 1 through 4 thereof, a new garment device embodying the principles and concepts of an embodiment of the disclosure and generally designated by the reference numeral 10 will be described.

As best illustrated in FIGS. 1 through 4, the protective garment assembly 10 generally comprises a suit 12 that may be worn by a user 14. The suit 12 may be comprised of a rigid material such as plastic or other similar material. The suit 12 includes a body portion 16 of the suit 12.

The body portion 16 of the suit 12 has a pair of sleeves 18 movably coupled to each of a pair of shoulders 20 of the body portion 16 of the suit 12. The user 14 wears the body portion 16 of the suit 12 so each of the user's legs 22 extends outwardly through a girdle 24 of the body portion 16 of the suit 12. Each of the user's arms 26 extends outwardly through an associated one of the pair of sleeves 18 on the body portion 16 of the suit 12. The body portion 16 of the suit 14 may be worn on the user's torso 28.

A helmet 30 is provided. The helmet 30 may be worn on the user's head 32. The helmet 30 may be an open face helmet of any conventional design.

The suit 12 includes a pair of arm portions 34 of the suit 12. The pair of arm portions 34 of the suit 12 each has an outer wall 36 extending between a first end 38 and a second end 40 of each of the pair of arm portions 34 of the suit 12. Each of the first 38 and second 40 ends of the pair of arm portions 34 of the suit 12 is open. The pair of arm portions 34 of the suit 12 is each substantially hollow. Finally, the outer wall 36 of each of the pair of arms portions 34 of the suit 12 has a cylindrical shape.

The outer wall 36 of each of the pair of arm portions 34 of the suit 12 is split between the first 38 and second 40 ends of each of the pair of arm portions 34 of the suit 12. Each of the pair of arm portions 34 of the suit 12 are positionable between an open and a closed position. Each of the pair of arm portions 34 of the suit 12 may be positioned around an associated one of the user's forearms 42.

The suit 12 includes a plurality of leg portions 44 of the suit 12. The plurality of leg portions 44 of the suit 12 each has an exterior wall 46 extending between each of a primary end 48 and a secondary end 50 of each of the plurality of leg portions 44 of the suit 12. Each of the primary 48 and secondary 50 ends of the plurality of leg portions 44 of the suit 12 is open. Additionally, each of the plurality of leg portions 44 of the suit 12 is substantially hollow. The exterior wall 46 of each of the plurality of leg portions 44 of the suit 12 has a cylindrical shape.

The exterior wall 46 of the plurality of leg portions 44 of the suit 12 is split between the primary 48 and secondary 50 ends of each of the plurality of leg portions 44 of the suit 12. Each of the plurality of leg portions 44 of the suit 12 is positionable between an open position and a closed position. Moreover, the plurality of leg portions 44 of the suit 12 may each be positioned around an associated one of the user's legs 22.

A plurality of locks 54 is provided. Each of the plurality of locks 54 is coupled to the outer 36 and exterior 46 walls of an associated one of each of the pair of arm portions 34 and plurality of leg portions 44 of the suit 12. The plurality of locks 54 are each positioned proximate the split in the exterior wall 46 and outer wall 36 of each of the pair of arm portions 34 and the plurality of leg portions 44 of the suit 12. The plurality of locks 54 retains each of the arm 34 and leg 44 portions of the suit 12 in the closed position.

The plurality of leg portions 44 of the suit 12 comprise a pair of sets 56 of the plurality of leg portions 44 of the suit 12. Each of the pair of sets 56 of the plurality of leg portions 44 of the suit 12 is positionable around an associated one of the user's upper 58 and lower 60 legs. Each of the user's knees 62 and each of the user's feet 64 are exposed.

A plurality of blades 66 is provided. Each of the plurality of blades 66 has a top edge 68 and a bottom edge 70. The top 68 and bottom 70 edges of the plurality of blades 66 taper to a point on a front end 71 of each of the plurality of blades 66. The bottom edge 70 of each of the plurality of blades 66 is coupled to each of the body 16, arm 34 and leg 44 portions of the suit 12. A constricting snake 72 cannot constrict the user 14 without being injured by the plurality of blades 66.

A group of body ones 74 of the plurality of blades 66 each is coupled to each of the pair of shoulders 20 of the body portion 16 of the suit 12 and each of the pair of sleeves 18 of the body portion 16 of the suit 12. Additionally, a pair of arm ones 76 of the plurality of blades 66 each is coupled to the outer wall 36 of an associated one of the pair of arm portions 34 of the suit 12. A group of leg ones 78 of the plurality of blades 66 each is coupled to the exterior wall 46 of an associated one of the pair of sets 56 of the plurality of leg portions 44 of the suit 12. Finally, a group of helmet ones 80 of the plurality of blades 66 is each coupled to an extraneous side 82 of the helmet 30.

In use, the user 14 wears each of the body 16, arm 34 and leg 44 portions of the suit 12 prior to going to sleep. The user 14 is protected from being attacked by the constricting snake 72 while the user 14 sleeps. Additionally, the user 14 wears the suit 12 if the user 14 is going to be entering the constricting snake's 72 natural environment.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A protective garment assembly configured to prevent a constricting snake from attacking a user, said assembly comprising:

a suit configured to be worn by the user, said suit comprising a body portion of said suit configured to be worn on the user's torso;

a pair of arm portions of said suit each configured to be positioned around an associated one of the user's arms, and a plurality of leg portions of said suit each configured to be positioned around an associated one of the user's legs, and a plurality of blades, each of said blades having an elongated top edge, each said blade being coupled to an associated one of said body, arm and leg portions of said suit such that said elongated top edge faces outwardly from said associated one of said body, arm and leg portions wherein the constricting snake cannot constrict the user without being injured by said plurality of blades.

2. The assembly according to claim 1, wherein said body portion of said suit having a pair of sleeves movably coupled to each of a pair of shoulders of said body portion of said suit, the user wearing said body portion of said suit such that each of the user's legs extends outwardly through a girdle of said body portion of said suit and each of the user's arms extends outwardly through an associated one of said pair of sleeves on said body portion of said suit.

3. The assembly according to claim 1, wherein said pair of arm portions of said suit each having an outer wall extending between a first end and a second end of each of said pair of arm portions of said suit, each of said first and second ends of said pair of arm portions of said suit being open, each of said pair of arm portions of said suit being substantially hollow.

4. The assembly according to claim 3, further comprising said outer wall of each of said pair of arm portions of said suit being split between said first and second ends of each of said pair of arm portions of said suit wherein each of said pair of arm portions of said suit are positionable between an open and a closed position.

5. The assembly according to claim 4, wherein each of the pair of arm portions of said suit is configured to be positioned around an associated one of the user's forearms.

6. The assembly according to claim 1, wherein said plurality of leg portions of said suit each having an exterior wall extending between each of a primary end and a secondary end of each of said plurality of leg portions of said suit, each of said primary and secondary ends of said plurality of leg portions of said suit being open, each of said plurality of leg portions of said suit being substantially hollow.

7. The assembly according to claim 6, further comprising said exterior wall of said plurality of leg portions of said suit being split between said primary and secondary ends of each of said plurality of leg portions of said suit wherein each of said plurality of leg portions of said suit is positionable between an open position and a closed position.

8. The assembly according to claim 1, wherein said plurality of leg portions of said suit comprising a pair of sets of said plurality of leg portions of said suit.

9. The assembly according to claim 8, further comprising each of said pair of sets of said plurality of leg portions of said suit being positionable around an associated one of the user's upper and lower legs.

10. The assembly according to claim 1, wherein a group of body ones of said plurality of blades each being coupled to each of a pair of shoulders of said body portion of said suit and each of a pair of sleeves of said body portion of said suit.

11. The assembly according to claim 10, further comprising a pair of arm ones of said plurality of blades each being coupled to an outer wall of an associated one of said pair of arm portions of said suit.

12. The assembly according to claim 11, further comprising a group of leg ones of said plurality of blades each being coupled to an exterior wall of an associated one of a pair of sets of said plurality of leg portions of said suit.

13. A protective garment assembly configured to prevent a constricting snake from attacking a user, said assembly comprising:

a suit configured to be worn by the user, said suit comprising a body portion of said suit, said body portion of said suit having a pair of sleeves movably coupled to each of pair of shoulders of said body portion of said suit, the user wearing said body portion of said suit such each of the user's legs extends outwardly through a girdle of said body portion of said suit and each of the user's arms extends outwardly through an associated one of said pair of sleeves on said body portion of said suit wherein said body portion of said suit is configured to be worn on the user's torso, a pair of arm portions of said suit, said pair of arm portions of said suit each having an outer wall extending between a first end and a second end of each of said pair of arm portions of said suit, each of said first and second ends of said pair of arm portions of said suit being open, each of said pair of arm portions of said suit being substantially hollow, said outer wall of each of said pair of arm portions of said suit being split between said first and second ends of each of said pair of arm portions of said suit wherein each of said pair of arm portions of said suit are positionable between an open and a closed position wherein each of the pair of arm portions of said suit is configured to be positioned around an associated one of the user's forearms, a plurality of leg portions of said suit, said plurality of leg portions of said suit each having an exterior wall extending between each of a primary end and a secondary end of each of said plurality of leg portions of said suit, each of said primary and secondary ends of said plurality of leg portions of said suit being open, each of said plurality of leg portions of said suit being substantially hollow, said exterior wall of said plurality of leg portions of said suit being split between said primary and secondary ends of each of said plurality of leg portions of said suit wherein each of said plurality of leg portions of said suit is positionable between an open position and a closed position wherein said plurality of leg portions of said suit is configured to be positioned around an associated one of the user's legs, and said plurality of leg portions of said suit comprising a pair of sets of said plurality of leg portions of said suit, each of said pair of sets of said plurality of leg portions of said suit being positionable around an associated one of the user's upper and lower legs;

a plurality of blades, each of said blades having an elongated top edge, each said blade being coupled to an associated one of said body, arm and leg portions of said suit such that said elongated top edge faces outwardly from said associated one of said body, arm and leg portions wherein the constricting snake cannot constrict the user without being injured by said plurality of blades;

a group of body ones of said plurality of blades each being coupled to each of said pair of shoulders of said body portion of said suit and each of said pair of sleeves of said body portion of said suit;

a pair of arm ones of said plurality of blades each being coupled to said outer wall of an associated one of said pair of arm portions of said suit; and a group of leg ones of said plurality of blades each being coupled to said exterior wall of an associated one of said pair of sets of said plurality of leg portions of said suit.

* * * * *